US007629302B2

(12) United States Patent
Yagishita

(10) Patent No.: US 7,629,302 B2
(45) Date of Patent: *Dec. 8, 2009

(54) LUBRICATING OIL ADDITIVE AND LUBRICATING OIL COMPOSITION

(75) Inventor: Kazuhiro Yagishita, Kanagawa (JP)

(73) Assignee: Nippon Oil Corporation, Minato-ku (JP)

( * ) Notice: Subject to any disclaimer, the term of this patent is extended or adjusted under 35 U.S.C. 154(b) by 281 days.

This patent is subject to a terminal disclaimer.

(21) Appl. No.: 10/538,426

(22) PCT Filed: Aug. 5, 2003

(86) PCT No.: PCT/JP03/09953

§ 371 (c)(1), (2), (4) Date: Jun. 10, 2005

(87) PCT Pub. No.: WO2004/055140

PCT Pub. Date: Jul. 1, 2004

(65) Prior Publication Data

US 2006/0063686 A1 Mar. 23, 2006

(30) Foreign Application Priority Data

Dec. 17, 2002 (JP) ..... 2002-364910

(51) Int. Cl.
*C10M 159/22* (2006.01)

(52) U.S. Cl. ..... 508/460

(58) Field of Classification Search ..... 508/390, 508/460

See application file for complete search history.

(56) References Cited

U.S. PATENT DOCUMENTS

| | | | | |
|---|---|---|---|---|
| 5,415,792 | A * | 5/1995 | Campbell | 508/459 |
| 5,458,807 | A * | 10/1995 | Tamoto | 508/192 |
| 5,767,045 | A * | 6/1998 | Ryan | 508/287 |
| 6,140,282 | A * | 10/2000 | Cartwright et al. | 508/398 |
| 6,153,565 | A * | 11/2000 | Skinner et al. | 508/391 |
| 6,159,911 | A * | 12/2000 | Katafuchi | 508/391 |
| 6,281,179 | B1 * | 8/2001 | Skinner et al. | 510/184 |
| 6,417,148 | B1 * | 7/2002 | Skinner et al. | 510/184 |
| 6,429,178 | B1 * | 8/2002 | Skinner et al. | 510/184 |
| 6,429,179 | B1 * | 8/2002 | Skinner et al. | 510/184 |
| 2002/0082176 | A1 * | 6/2002 | Chambard et al. | 508/371 |
| 2002/0103088 | A1 | 8/2002 | Katafuchi et al. | |
| 2004/0102335 | A1 * | 5/2004 | Carrick et al. | 508/192 |

FOREIGN PATENT DOCUMENTS

| | | |
|---|---|---|
| EP | 1 227 145 | 7/2002 |
| EP | 1 526 169 | 4/2005 |
| EP | 1 526 170 | 4/2005 |
| EP | 1 561 799 | 8/2005 |
| GB | 1146925 | 3/1969 |
| GB | 1184020 | 3/1970 |
| GB | 1372532 | 11/1971 |
| JP | 08-176583 | 7/1996 |
| JP | 08-283764 | 10/1996 |
| JP | 10-053784 | 2/1998 |
| JP | 10-102082 | 4/1998 |
| JP | 11-029784 | 2/1999 |
| JP | 11-302679 | 11/1999 |
| JP | 2002 212579 | 7/2002 |
| WO | WO 94/28095 | 12/1994 |
| WO | WO 01/44417 | 6/2001 |

* cited by examiner

*Primary Examiner*—Glenn Caldarola
*Assistant Examiner*—Jim Goloboy
(74) *Attorney, Agent, or Firm*—Ladas & Parry LLP

(57) ABSTRACT

A lubricating oil additive and a lubricating oil composition wherein no precipitation is generated to exhibit a good storage stability even if a combination of a salicylate detergent and another metal detergent is used is provided by rendering the additive and composition an additive and a composition obtained by incorporating, into a lubricant base oil, (A) an alkali metal or alkaline earth metal salicylate having at its 3 and 5-positions hydrocarbon groups having 1 to 40 carbon atoms and a (per)basic salt, and (B) a metal detergent other than any salicylate detergent.

4 Claims, No Drawings

LUBRICATING OIL ADDITIVE AND LUBRICATING OIL COMPOSITION

TECHNICAL FIELD

The present invention relates to a lubricating oil additive and a lubricating oil composition, specifically, a lubricating oil additive and a lubricating oil composition into which two or more metal detergents are incorporated to exhibit good storage stability.

BACKGROUND ART

Lubricating oils are required to have various performances in accordance with their use purposes. In particular, engine oils are required to have high thermal stability, high-temperature detergency, oxidization stability, wear prevention and others, and are produced by incorporating lubricating oil additives such as an anti-wear agent, an ashless dispersing agent, a metal detergent, and an antioxidant thereinto. Examples of the metal detergent include such as salicylates, phenates and sulfonates. These are used alone or in combination in order to improve the high-temperature detergency and other properties of lubricating oils.

About such a technical field, for example, patent document 1 (Japanese Patent Application Laid-Open (JP-A) No. 8-176583) and patent document 2 (JP-A No. 10-53784) disclose diesel engine oil compositions into which a combination of metal detergents having different base numbers is incorporated.

However, the following have been coming to light: in the case of using a combination of a monoalkyl salicylate and a metal detergent (such as a sulfonate) other than any salicylate both of which have been in general commercially available and used hitherto, calcium carbonate and others, which are dispersed in the metal detergent, precipitate when the composition is stored, so as to cause the following problems: the clogging of a producing line filter, a shipping line filter, an engine filter and so on for the lubricating oil additives and the lubricating oil; a drop in qualities required as products of the lubricating oil additives or the lubricating oil, such as a drop in the base number thereof; the generation of abnormal abrasion when the composition is actually used; and others. In particular, in the case of using a monoalkyl salicylate made into a (per)base by use of calcium carbonate, calcium borate or the like together with a neutral or (per)basic sulfonate detergent, in particular, a neutral sulfonate, precipitation is generated at an early stage. Thus, this combination cannot be virtually used in any lubricating oil additive or lubricating oil product under the present circumstances. Thus, the circumstances have been desired to be improved.

DISCLOSURE OF THE INVENTION

In light of situations as described above, it is an object of the present invention to provide a lubricating oil additive and a lubricating oil composition which comprise a combination of a salicylate detergent and a metal detergent other than it wherein no precipitation is generated to exhibit a good storage stability. Patent document 2, paragraph (0010) specifically describes SAP 001, SAP 005, and SAP 007 manufactured by Shell Chemicals Japan and OSCA 435B and OSCA 463 manufactured by Osca Chemical as examples of a "highly basic calcium salicylate/magnesium salicylate", and patent document 2, paragraph (0012) specifically describes SAP 002 manufactured by Shell Chemicals Japan and OSCA 431B manufactured by Osca Chemical as "low basic calcium salicylates". However, all of these commercially available products are products made mainly of a monoalkyl type salicylate (the constituent ratio of the monoalkyl salicylate in the salicylate structure thereof is over 90% by mole). Furthermore, patent documents 1 and 2 are not even aware of problems as described above.

The inventors have paid attention to the structure of a salicylate as a metal detergent, and made eager investigations to find out that in the case of using a combination of a salicylate having a specific structure and a metal detergent other than any salicylate, no precipitation is generated in the form of a lubricating oil additive or a lubricating oil composition so that a very good storage stability is exhibited. Thus, the present invention has been made.

Accordingly, the present invention is a lubricating oil additive and a lubricating oil composition obtained by incorporating, into a lubricant base oil, (A) a salicylate detergent and (B) a metal detergent other than any salicylate detergent, wherein the salicylate detergent (A) is an alkali metal or alkaline earth metal salicylate represented by the general formula (1) and/or a (per)basic salt thereof:

(1)

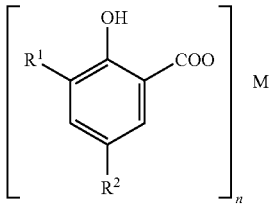

wherein $R^1$ and $R^2$ may be the same or different and each represent a hydrocarbon group having 1 to 40 carbon atoms, the hydrocarbon group may contain oxygen or nitrogen, M represents an alkali metal or alkaline earth metal, and n is 1 or 2 in accordance with the valence of the metal.

It is preferred that one of $R^1$ and $R^2$ in the general formula (1) is a hydrocarbon which has 10 to 40 carbon atoms, and the other is a hydrocarbon which has less than 10 carbon atoms (and may have oxygen or nitrogen) or $R^1$ and $R^2$ are each a hydrocarbon group having 10 to 40 carbon atoms.

The lubricating oil additive and the lubricating oil composition of the present invention are particularly useful in the case where the metal ratio of the component (A) is 1.1 or more.

It is preferred that the metal detergent (B) other than any salicylate detergent is at least one selected from alkali metal or alkaline earth metal sulfonates, alkali metal or alkaline earth metal phenates, and (per)basic salts thereof.

It is preferred that the lubricating oil additive and the lubricating oil composition of the present invention further comprise at least one lubricating oil additive selected from (C) an anti-wear agent, (D) an ashless dispersing agent, and (E) an antioxidant.

BEST MODES FOR CARRYING OUT THE INVENTION

The present invention will be described in detail hereinafter.

As the lubricant base oil in the lubricating oil additive and the lubricating oil composition of the present invention, a mineral type base oil or synthetic type base oil that is used in ordinary lubricating oil can be used without any especial limit.

Specific examples of the mineral oil type base oil include oils obtained by purifying a lubricating oil fraction yielded by distilling an atmospheric residue oil, which is obtained by distilling crude oil under normal pressure, under reduced pressure by at least one selected from solvent deasphalting, solvent extraction, hydrocracking, solvent dewaxing, hydrorefining and other treatments; wax-isomerized mineral oils; and base oils produced by isomerizing GTL wax (gas-to-liquid wax).

Specific examples of the synthetic type base oil include polybutene or hydrogenated products thereof; poly-α-olefins, such as 1-octene oligomer and 1-decene oligomer, or hydrogenated products thereof; diesters such as ditridecyl glutarate, di-2-ethylhexyl adipate, diisodecyl adipate, ditridecyl adipate and di-2-ethylhexyl cebacate; polyol esters such as trimethylolpropane caprilate, trimethylolpropane pelargonate, pentaerythritol-2-ethyl hexanoate, and pentaerythritol pelargonate; and aromatic synthesis oils such as alkylnaphthalene, alkylbenzene, and aromatic esters; and mixtures thereof.

In the invention, the above-mentioned mineral oil type base oils, the above-mentioned synthetic type base oils, or any mixture composed of two or more lubricating oils selected therefrom can be used. Examples thereof include one or more out of the mineral oil type base oils, one or more out of the synthetic type base oils, and a mixture of one or more out of the mineral oil type base oils and one or more out of the synthetic type base oils.

The aromatic fraction content in the lubricant base oil is not particularly limited, and the content as % $C_A$ is preferably 10 or less, more preferably 3 or less, in particular preferably 2 or less by mass. When the aromatic fraction content in the base oil is set as described above, a composition better in oxidation stability can be obtained. The "% $C_A$" represents the percentage of the number of the aromatic carbon atoms to the number of all the carbon atoms, the percentage being obtained by ring analysis prescribed in ASTM D 3238.

The kinematic viscosity of the lubricant base oil is not particularly limited, and the kinematic viscosity at 100° C. is preferably 20 $mm^2/s$ or less, more preferably 10 $mm^2/s$ or less in order to keep the low-temperature viscosity property good. On the other hand, the kinematic viscosity is preferably 1 $mm^2/s$ or more, more preferably 2 $mm^2/s$ or more in order to form a sufficient oil film at lubrication places, thereby keeping lubricity and further control the evaporation loss of the lubricant base oil into a low value.

The evaporation loss quantity of the lubricant base oil is 20% or less by mass, more preferably 16% or less by mass, and in particular preferably 10% or less by mass as NOACK evaporation quantity. When the NOACK evaporation quantity of the lubricant base oil is kept at a value of 20% or less by mass, the evaporation loss of the lubricating oil can be controlled into a low value and further in the case of using the lubricating oil composition as a lubricating oil for internal combustion engine, it is possible to prevent sulfur compounds, phosphorus compounds or metals in the composition from being deposited together with the lubricant base oil on an exhaust gas purifying device so as to prevent a bad effect on the exhaust gas purifying performance in advance. The NOACK evaporation quantity referred to herein is measured in accordance with CEC L-40-T-87.

The viscosity index of the lubricant base oil is not particularly limited, and the value thereof is preferably 80 or more, more preferably 100 or more, and even more preferably 120 or more to obtain a good viscometric property at temperatures from low temperature and high temperature.

The component (A) in the invention is an alkali metal or alkaline earth metal salicylate represented by the general formula (1) and/or a (per)basic salt thereof:

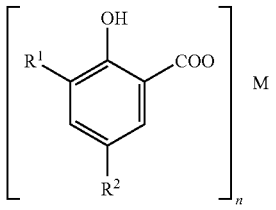

(1)

wherein $R^1$ and $R^2$ may be the same or different and each represent a hydrocarbon group having 1 to 40 carbon atoms, the hydrocarbon group may contain oxygen or nitrogen, M represents an alkali metal or alkaline earth metal such as sodium, potassium, calcium and magnesium, and is preferably calcium or magnesium, more desirably calcium, and n is 1 or 2 in accordance with the valence of the metal.

Examples of the hydrocarbon group having 1 to 40 carbon atoms include alkyl, cycloalkyl, alkenyl, alkyl-substituted cycloalkyl, aryl, alkyl-substituted aryl and arylalkyl groups. Specific examples thereof include alkyl groups which have 1 to 40 carbon atoms (and may be linear or branched) such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms such as cyclopentyl, cyclohexyl and cycloheptyl; alkylcycloalkyl groups having 6 to 10 carbon atoms (the position(s) where the alkyl group(s) is/are substituted on the cycloalkyl group being arbitrary) such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, and dimethylcycloheptyl, methylethylcycloheptyl; alkenyl groups (which may be linear or branched, the position of the double bond therein being arbitrary) such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl and nonadecenyl groups; aryl groups such as phenyl and naphthyl groups; alkylaryl groups having 7 to 10 carbon atoms (wherein the alkyl group(s) may be linear or branched, the position(s) where the alkyl group(s) is/are substituted on the aryl group being arbitrary) such as tolyl, xylyl, ethylphenyl, propylphenyl, and butylphenyl groups; and arylalkyl groups which have 7 to 10 carbon atoms (the alkyl group being allowable to be linear or branched) such as benzyl, phenylethyl, phenylpropyl, and phenylbutyl groups.

$R^1$ can be combined with $R^2$ without any especial limitation. Preferred examples of the combination thereof are the following combination (1) or (2):

(1) One of $R^1$ and $R^2$ is a hydrocarbon group having 10 to 40 carbon atoms, preferably 10 to less than 20 carbon atoms, or 20 to 30 carbon atoms, and the other is a hydrocarbon having less than 10 carbon atoms, preferably less than 5 carbon atoms, in particular preferably 1 carbon atom; or (2) $R^1$ and $R^2$ are each a hydrocarbon group having 10 to 40 carbon atoms, preferably 10 to less than 20 carbon atoms, or 20 to 30 carbon atoms, and these are preferably the same as each other.

The hydrocarbon group having 10 to 40 carbon atoms is preferably a secondary alkyl group derived from a polymer or copolymer made from ethylene, propylene, butylene or the like and represented by the following general formula (2):

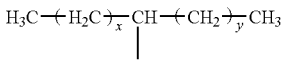

(2)

wherein x and y are each an integer from 0 to 37 and x+y is from 7 to 37; preferably, x and y are each an integer from 0 to 27 and x+y is from 7 to 27; more preferably, x and y are each an integer from 0 to 16 and x+y is from 7 to 16 or x and y are each an integer from 0 to 23 and x+y is from 17 to 23; and in particular preferably, x and y are each an integer from 0 to 15 and x+y is from 11 to 15.

The hydrocarbon having less than 10 carbon atoms may be an alkyl group having 1 to less than 10 carbon atoms such as a methyl, ethyl, butyl, or t-butyl group, and may contain oxygen or nitrogen. An example thereof is a —COOH group. Of these, t-butyl and methyl groups are preferable and a methyl group is most preferable.

The process for producing the component (A) is not particularly limited, and a known process disclosed in JP-B-48-35325, JP-B-50-3082 or the like can be used. For example, in the case where one of $R^1$ and $R^2$ is an alkyl group having 10 to less than 20 carbon atoms or 20 to 30 carbon atoms and the other is a methyl group, the component (A) can be obtained by using an o-cresol or p-cresol as a starting material to alkylate the p-position or o-position thereof with an olefin having 10 to less than 20 carbon atoms or 20 to 30 carbon atoms, carboxylating the resultant, and further causing the resultant to react with a metal base such as an oxide or hydroxide of an alkali metal or alkaline earth metal or converting the resultant once into an alkali metal salt such as a sodium or potassium salt and then substituting the salt with an alkaline earth metal salt. In the case where phenol is used as a starting material, it is advisable to produce the component (A) through steps of using an olefin having 10 to less than 20 carbon atoms or 20 to 30 carbon atoms in an amount of 1.5 to 4 moles, preferably 2 to 3 moles per mole of phenol to conduct alkylation followed by carboxylation (or steps reverse thereto).

About the component (A) in the invention, salicylates other than the salicylate represented by the general formula (1), that is, monoalkyl salicylates having 1 to 40 carbon atoms such as 3-alkyl salicylate, 4-alkyl salicylate and 5-alkyl salicylate may be contained as components resulting from impurities in the process of producing the salicylate represented by the general formula (1) or as optional components. The constituent ratio thereof is preferably 50% or less by mole, more preferably 30% or less by mole, even more preferably 10% or less by mole, most preferably approximately 0% by mole. In the case where the content of the monoalkyl salicylate(s) is restricted as described above, a composition wherein the generation of a precipitation is suppressed can be obtained when the component (A) is used together with a sulfonate or the like. In the case of, for example, 3-alkyl-5-methyl salicylate, 3-methyl-5-alkyl salicylate or the like, which is obtained by use of o-cresol or p-cresol as a starting material as described above, monoalkyl salicylates are not substantially contained. In the case of a dialkyl salicylate, which is obtained by use of the above-mentioned phenol as a starting material, the content of monoalkyl salicylate(s) can be decreased by using an olefin in an amount of 2 moles or more per the phenol to conduct alkylation or by separating and removing monoalkyl salicylate(s) from the resultant mono- and di-alkyl salicylate mixture.

The component (B) in the lubricating oil additive and the lubricating oil composition of the invention is a metal detergent other than any salicylate detergent. That is, examples thereof include alkali metal or alkaline earth metal detergents made of sulfonates, phenates, carboxylates and naphthenates of alkali metal or alkaline earth metals. In the invention, one or more alkali metal or alkaline earth metal detergents can be used which are selected from the group consisting of the above. Alkaline earth metal sulfonate detergents and alkaline earth metal phenate detergents, in particular, alkaline earth metal sulfonate detergents are preferably used.

The alkaline earth metals are each an alkaline earth metal salt, in particular, a magnesium salt and/or a calcium salt of an alkyl aromatic sulfonic acid obtained by sulfonating an alkyl aromatic compound having a molecular weight of 300 to 1500, preferably 400 to 700, and the calcium salt is preferably used.

Specific examples of the alkyl aromatic sulfonic acid include petroleum sulfonic acid and synthetic sulfonic acid.

As the petroleum sulfonic acid, there is generally used a sulfonated alkyl aromatic compound of a lubricant fraction of mineral oil or the so-called mahogany acid, which is produced as a byproduct when white oil is produced. As the synthetic sulfonic acid, there is used, for example, a sulfonated alkylbenzene having a linear or branched alkyl group, which is obtained by alkylating benzene with an oligomer of an olefin having 2 to 12 carbon atoms (such as ethylene or propylene), or a product obtained by sulfonating an alkylnaphthalene such as dinonylnaphthalene. The sulfonating agent used when these alkyl aromatic compounds are sulfonated is not limited to any especial kind. Usually, fuming sulfuric acid or sulfuric anhydride is used.

Examples of the alkaline earth metal phenates include alkaline earth metal salts, in particular, magnesium and calcium salts of Mannich reactants of alkyl phenol, alkylphenol sulfide or alkylphenol. Specific examples thereof include substances represented by the following formulae (3), (4) and (5):

(3)

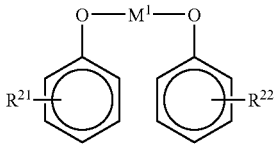

(4)

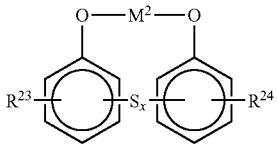

(5)

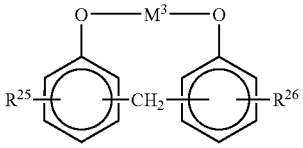

wherein $R^{21}$, $R^{22}$, $R^{23}$, $R^{24}$, $R^{25}$ and $R^{26}$ may be the same or different and each represent a linear or branched alkyl group having 4 to 30 carbon atoms, preferably 6 to 18 carbon atoms, and $M^1$, $M^2$ and $M^3$ each represent an alkaline earth metal, preferably calcium or magnesium, and x represents 1 or 2.

Specific examples of $R^{21}$, $R^{22}$, $R^{23}$, $R^{24}$, $R^{25}$ and $R^{26}$, which are each independent, include butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups. These may be linear or branched. These may also be primaryl alkyl, secondary alkyl or tertiary alkyl groups.

Examples of the component (A) and component (B) of the invention include not only neutral salts as described above but also basic salts obtained by heating these neutral salts together with an excessive amount of an alkali metal or alkaline earth metal salt or an alkali metal or alkaline earth metal base (a hydroxide or oxide of an alkali metal or alkaline earth metal) in the presence of water; and perbasic salts obtained by causing the neutral salts to react with a base such as a hydroxide of an alkali metal or alkaline earth metal in the presence of carbon dioxide gas, boric acid or a borate.

These reactions are usually conducted in a solvent (an aliphatic hydrocarbon solvent such as hexane, an aromatic hydrocarbon solvent such as xylene, a light lubricant base oil, or the like), so as to yield salts having a metal content of 1.0 to 20% by mass, preferably 2.0 to 16% by mass.

In the invention, the metal ratio of the component (A) or component (B) is not particularly limited, and the component (A) and component (B) having a metal ratio of 1 to 40, preferably 1 to 20 can be used. The metal ratio of the component (A) is 1.1 or more, preferably 1.5 or more, in particular preferably 2.3 or more, and is preferably 10 or less, more preferably 6 or less since the salicylate which may generate a precipitation is a monoalkyl salicylate made into a (per)base with calcium carbonate or the like. The component (A) having a metal ratio within such a range is very useful. In the case of using the above-mentioned monoalkyl salicylate, which has a metal ratio of 1.1 or more, for example, a monoalkyl salicylate having a metal ratio of 2.7 together with a sulfonate detergent as the component (B), a precipitation is generated whether the metal ratio of the sulfonate detergent is 1 or 10. However, as the metal ratio of the sulfonate detergent is smaller (in the case where the ratio is, for example, 5 or less, or 2 or less, in particular 1), a precipitation is generated at an earlier stage. It is therefore very useful to use the component (B) having such a small metal ratio together with the component (A) having a metal ratio as described above. In the case where the metal ratios of the components (A) and (B) are each 1, a precipitation resulting from calcium carbonates or the like is not generated. Thus, this case is also preferred.

The metal ratio referred to herein is represented by (the valence of the metal element in an alkali metal or alkaline earth metal salicylate, an alkali metal or alkaline earth metal sulfonate, or the like)×(content (% by mole) of the metal element therein/(content (% by mole) of the soap group therein). The metal element means calcium, magnesium or the like, and the soap group means the alkylsalicylic acid group, the alkylsulfonic acid group, or the like.

In the lubricating oil additive and the lubricating oil composition of the invention, the contents of the component (A) and the component (B) are not particularly limited, and are decided as the needs arise for a lubricating oil additive or a lubricating oil product. The lower limit of each of the contents is 0.01% by mass, preferably 0.1% by mass of the whole of the composition. The upper limit thereof is 40% by mass, preferably 20% by mass, in particular preferably 10% or less by mass. When the composition of the invention is used as a lubricating oil composition for internal combustion engine, preferred examples of the contents of the component (A) and the component (B) are as follows: the amount of the component (A) is 5% or less by mass, preferably 1% or less by mass, more preferably 0.5% or less by mass, even more preferably 0.3% or less by mass of the whole of the lubricating oil composition, and the amount of the component (B) is 5% or less by mass, preferably 1% or less by mass, more preferably 0.5% or less by mass, even more preferably 0.3% or less by mass, most preferably 0.15% or less by mass of the whole of the lubricating oil composition, these amounts being in terms of the amounts of the alkali metal or alkaline earth metal element. In the case of the component (B) (in particular, a sulfonate) having a metal ratio of 2 or less, it is desired that the component is incorporated preferably in an amount of 0.08% or less by mass, in particular preferably in an amount of 0.05% or less by mass since the content of the soap group (such as sulfonic acid) becomes relatively high.

The lubricating oil additive and the lubricating oil composition of the invention are a lubricating oil additive and a lubricating oil composition wherein the component (A) and the component (B) are incorporated into a lubricant base oil, and are good in not only storage stability but also high-temperature detergency, base number maintainability, oxidization stability and others. In order to make the performances better and make other required performances better, one or more additives may be arbitrarily incorporated thereinto, the additives being selected from (C) an anti-wear agent, (D) an ashless dispersing agent, and (E) an antioxidant, or from known additives such as a friction modifier, a viscosity index improver, a corrosion inhibitor, a rust inhibitor, an anti-emulsifier, a metal inactivator, an antifoaming agent, and a colorant. The resultant composition can be supplied as an additive package or lubricating oil product into which these are incorporated.

Examples of the anti-wear agent (C) include sulfur-containing compounds such as zinc dithiophosphate, zinc dithiocarbamate, thiophosphoric acid esters, disulfides, olefin sulfides, and oil and fat sulfides; monoesters or diesters of phosphorous acid or phosphoric acid, metal (such as zinc) salts thereof, and amine salts thereof; and triesters of phosphorous acid or phosphoric acid. These may be incorporated usually at a ratio of 0.1 to 20% by mass, preferably at a ratio of 0.2 to 10% by mass. The component (A) in the invention less easily hinders the effect of the anti-wear agent (C) than any monoalkyl type salicylate; therefore, when the component (C) is used in the lubricating oil composition of the invention, the content thereof can be decreased. In the case of, for example, an anti-wear agent containing sulfur, the amount of the agent (C) can be 0.2% or less by mass, preferably 0.15% or less by mass of the whole of the lubricating oil composition, the amount being in terms of the amount of the sulfur element therein. In the case of, for example, an anti-wear agent containing phosphorus, the amount of the agent (C) can be 0.08% or less by mass, more restrictedly 0.05% or less by mass of the whole of the lubricating oil composition, the amount being in terms of the amount of the phosphorus element therein. Such a case is useful when the composition of the invention is used as a lubricating oil composition for internal combustion engine. This is because a bad effect thereof onto an exhaust gas purifying catalyst can be decreased.

Examples of the ashless dispersing agent (D) include succinimide ashless dispersing agents, benzylamine ashless dispersing agents, polybutenylamine ashless dispersing agents, and compounds obtained by modifying these compounds with a boron compound, a oxygen-containing organic compound, a phosphorus compound, a sulfur compound or the like. These may be incorporated usually at a ratio of 0.1 to 20% by mass, preferably at a ratio of 0.5 to 10% by mass.

As the antioxidant (E), any antioxidant that is ordinarily used in lubricating oil can be used, examples thereof including phenol type antioxidants such as 2,6-di-tert-butyl-4-methylphenol, 4,4'-methylenebis(2,6-di-tert-butylphenol), octyl-3-(3,5-di-tert-butyl-4-hydroxyphenyl)propionate, and octyl-3-(3-methyl-5-tert-butyl-4-hydroxyphenyl)propionate, amine type antioxidants such as phenyl-α-naphthylamine, alkylphenyl-α-naphthylamine, and dialkyldiphenylamine, and metal type antioxidants such as molybdenum and copper antioxidants. These may be incorporated usually at a ratio of 0.1 to 10% by mass, preferably at a ratio of 0.1 to 5% by mass.

Examples of the friction modifier include molybdenum dithiophosphate, molybdenum dithiocarbamate, aliphatic acid esters, aliphatic amines, aliphatic amides, and aliphatic ethers.

Specific examples of the viscosity index improver include the so-called non-dispersion type viscosity index improvers, which are polymers or copolymers made from one or more monomers selected from various methacrylic acid esters, or hydrogenated products thereof; the so-called dispersion type viscosity index improvers, which are obtained by copolymerizing them further with various methacrylic acid esters containing a nitrogen compound; non-dispersion type or dispersion type ethylene/α-olefin copolymers (examples of the α-olefin including propylene, 1-butene and 1-pentene), or hydrogenated products thereof; polyisobutylene, or hydrogenated products thereof; hydrogenated products of styrene/diene copolymer; styrene/anhydrous maleic acid ester copolymer; and polyalkylstyrene.

It is necessary that the molecular weight of these viscosity index improvers is selected, considering shear stability. Specifically, the number-average molecular weight of the viscosity index improvers is usually from 5,000 to 1,000,000, preferably from 100,000 to 900,000 in the case of, for example, the dispersion type and the non-dispersion type polymethacrylates; is usually from 800 to 5,000, preferably from 1,000 to 4,000 in the case of the polyisobutylene or the hydrogenated products thereof; and is usually from 800 to 500,000, preferably from 3,000 to 200,000 in the case of the ethylene/α-olefin copolymers or the hydrogenated products thereof.

In the case where the ethylene/α-olefin copolymers or the hydrogenated products thereof are used out of these viscosity index improvers, a lubricating oil additive and a lubricating oil composition particularly good in shear stability can be obtained. One or more compounds selected at will from the above-mentioned viscosity index improvers can be contained in an arbitrary amount.

Examples of the corrosion inhibitor include benztriazole type, tolyltriazole type, thiadiazole type, and imidazole type compounds.

Examples of the rust inhibitor include petroleum sulfonate, alkylbenzenesulfonate, dinonylnaphthalenesulfonate, alkenylsuccinic acid esters, and polyhydric alcohol esters.

Examples of the anti-emulsifier include polyalkylene glycol type nonionic surfactants such as polyoxyethylene alkyl ether, polyoxyethylene alkyl phenyl ether and polyoxyethylene alkyl naphthyl ether.

Examples of the metal inactivator include imidazolin, pyrimidine derivatives, alkylthiadiazole, mercaptobenzothiazole, benzotriazole or derivatives thereof,
1,3,4-thiadiazole polysulfide,
1,3,4-thiazolyl-2,5-bisdialkyldithiocarbamate,
2-(alkyldithio)benzimidazole, and
β-(o-carboxybenzylthio)propionitrile.

Examples of the antifoamer include silicone, fluorosilicone, and fluoroalkyl ether.

In the case where these additives are incorporated into the lubricating oil additive of the invention, these additives can be appropriately added in accordance with the use purpose of a lubricating oil composition wherein the lubricating oil additive is to be used, so as to construct the so-called additive package. When one of these additives is incorporated into the lubricating oil composition of the invention, the content thereof is usually selected from the range of 0.1 to 5% by mass of the whole of the lubricating oil composition in the case of the friction modifier, from the range of 0.1 to 20% by mass thereof in the case of the viscosity index improver, from the range of 0.005 to 5% by mass thereof in the case of the corrosion inhibitor, the rust inhibitor or the anti-emulsifier, form the range of 0.005 to 1% by mass thereof in the case of the metal inactivator, and from the range of 0.0005 to 1% by mass thereof in the case of the antifoamer.

EXAMPLES

The content of the present invention will be more specifically described by way of the following examples and comparative examples. However, the invention is not limited by these examples.

Examples 1 to 8, and Comparative Examples 1 to 8

As shown in Tables 1 and 2, lubricating oil compositions of the invention (Examples 1 to 8) and lubricating oil compositions for comparison (Comparative Examples 1 to 8) were each prepared.

TABLE 1

| | | Example 1 | Example 2 | Example 3 | Example 4 | Example 5 | Example 6 | Example 7 | Example 8 |
|---|---|---|---|---|---|---|---|---|---|
| Hydro-refined mineral oil 1) | % by mass | Balance | | Balance | | Balance | | Balance | |
| Solvent refined mineral oil 2) | % by mass | | Balance | | Balance | | Balance | | Balance |
| Perbasic Ca monoalkylsalicylate 1 3) | % by mass | — | — | — | — | — | — | — | — |
| Amount in terms of the alkaline earth metal element | % by mass | — | — | — | — | — | — | — | — |
| Perbasic Ca monoalkylsalicylate 2 4) | % by mass | — | — | — | — | — | — | — | — |
| Amount in terms of the alkaline earth metal element | % by mass | — | — | — | — | — | — | — | — |
| (A) Perbasic Ca 3-alkyl-5-methylsalicylate 5) | % by mass | 4 | 4 | 2.5 | 2.5 | — | — | — | — |
| Amount in terms of the alkaline earth metal element | % by mass | (0.24) | (0.24) | (0.18) | (0.18) | — | — | — | — |

TABLE 1-continued

| | | Example 1 | Example 2 | Example 3 | Example 4 | Example 5 | Example 6 | Example 7 | Example 8 |
|---|---|---|---|---|---|---|---|---|---|
| (A) Perbasic Ca dialkylsalicylate 6) | % by mass | — | — | — | — | 4 | 4 | 2.5 | 2.5 |
| Amount in terms of the alkaline earth metal element | % by mass | — | — | — | — | (0.24) | (0.24) | (0.18) | (0.18) |
| (B) Neutral Ca sulfonate 7) | % by mass | 1 | 1 | — | — | 1 | 1 | — | — |
| Amount in terms of the alkaline earth metal element | % by mass | (0.02) | (0.02) | — | — | (0.02) | (0.02) | — | — |
| (B) Perbasic ca sulfonate 8) | % by mass | — | — | 1 | 1 | — | — | 1 | 1 |
| Amount in terms of the alkaline earth metal element | % by mass | — | — | (0.1) | (0.1) | — | — | (0.1) | (0.1) |
| (C)ZDTP 9) | % by mass | 1 | 1 | 1 | 1 | 1 | 1 | 1 | 1 |
| Amount in terms of the phosphorus element | % by mass | (0.07) | (0.07) | (0.07) | (0.07) | (0.07) | (0.07) | (0.07) | (0.07) |
| (D) Ashless dispersing agent 10) | % by mass | 5 | 5 | 5 | 5 | 5 | 5 | 5 | 5 |
| (E) Antioxidant 11) | % by mass | 2 | 2 | 2 | 2 | 2 | 2 | 2 | 2 |
| Viscosity index improver 12) | % by mass | 4 | 4 | 4 | 4 | 4 | 4 | 4 | 4 |
| Anti-emulsifier 13) | % by mass | 0.01 | 0.01 | 0.01 | 0.01 | 0.01 | 0.01 | 0.01 | 0.01 |
| Storage stability test (vol %) | 1 WEEK | Not generated | Not generated | Not generated | Not generated | Not generated | Not generated | Not generated | Not generated |
| | 2 WEEK | Not generated | Not generated | Not generated | Not generated | Not generated | Not generated | Not generated | Not generated |
| | 3 WEEK | Not generated | Not generated | Not generated | Not generated | Not generated | Not generated | Not generated | Not generated |
| | 4 WEEK | Not generated | Not generated | Not generated | Not generated | Not generated | Not generated | Not generated | Not generated |

1) % $C_A$: 0, Sulfur content: 0 ppm by mass, 100° C. kinematic viscosity: 6.5 $mm^2/s$, viscosity index: 125
2) % $C_A$: 6.5, Sulfur content: 1700 ppm by mass, 100° C. kinematic viscosity: 6.9 $mm^2/s$, viscosity index: 100
3) Infineum C9371(SAP001) Total base value: 170 mgKOH/g, Ca content: 6.1% by mass, Metal ratio: 2.7, Alkyl groups: C14, C16, C18, Constituent ratio of monoalkyl compounds: 96 mol %
4) OSCA463 Total base value: 170 mgKOH/g, Ca content: 6.1% by mass, Metal ratio: 2.7, Alkyl groups: C14, C16, C18, Constituent ratio of monoalkyl compounds: 95 mol %
5) Total base value: 170 mgKOH/g, Ca content: 6.1% by mass, Metal ratio: 2.7, Alkyl groups: C14, C16, C18
6) Total base value: 170 mgKOH/g, Ca content: 6.1% by mass, Metal ratio: 2.7, Alkyl groups: C14, C16, C18
7) Total base value: 20 mgKOH/g, Ca content: 2.35% by mass, Metal ratio: 1.0
8) Total base value: 300 mgKOH/g, Ca content: 10.4% by mass, Metal ratio: 10.0
9) Alkyl group: 1,3-dimethylbutyl group, Phosphorus content: 7.2% by mass, Sulfur content: 14.4% by mass
10) Polybutenylsuccnimide, Number-average molecular weight of the polybutenyl groups: 1300
11) Phenol type and amine type antioxidants (1:1)
12) OCP Average molecular weight: 150000
13) Anti-emulsifier: polyoxyethylene alkyl ether

TABLE 2

| | | Comparative example 1 | Comparative example 2 | Comparative example 3 | Comparative example 4 | Comparative example 5 | Comparative example 6 | Comparative example 7 | Comparative example 8 |
|---|---|---|---|---|---|---|---|---|---|
| Hydro-refined mineral oil 1) | % by mass | Balance | | Balance | | Balance | | Balance | |
| Solvent refined mineral oil 2) | % by mass | | Balance | | Balance | | Balance | | Balance |
| Perbasic Ca monoalkylsalicylate 1 3) | % by mass | 4 | 4 | 2.5 | 2.5 | — | — | — | — |
| Amount in terms of the alkaline earth metal element | % by mass | (0.24) | (0.24) | (0.18) | (0.18) | — | — | — | — |
| Perbasic Ca monoalkylsalicylate 2 4) | % by mass | — | — | — | — | 4 | 4 | 2.5 | 2.5 |
| Amount in terms of the alkaline earth metal element | % by mass | — | — | — | — | (0.24) | (0.24) | (0.18) | (0.18) |
| (A) Perbasic Ca 3-alkyl-5-methylsalicylate 5) | % by mass | — | — | — | — | — | — | — | — |
| Amount in terms of the alkaline earth metal element | % by mass | — | — | — | — | — | — | — | — |
| (A) Perbasic Ca dialkylsalicylate 6) | % by mass | — | — | — | — | — | — | — | — |
| Amount in terms of the alkaline earth metal element | % by mass | — | — | — | — | — | — | — | — |
| (B) Neutral Ca sulfonate 7) | % by mass | 1 | 1 | — | — | 1 | 1 | — | — |
| Amount in terms of the alkaline earth metal element | % by mass | (0.02) | (0.02) | — | — | (0.02) | (0.02) | — | — |
| (B) Perbasic ca sulfonate 8) | % by mass | — | — | 1 | 1 | — | — | 1 | 1 |
| Amount in terms of the alkaline earth metal element | % by mass | — | — | (0.1) | (0.1) | — | — | (0.1) | (0.1) |
| (C)ZDTP 9) | % by mass | 1 | 1 | 1 | 1 | 1 | 1 | 1 | 1 |
| Amount in terms of the phosphorus element | % by mass | (0.07) | (0.07) | (0.07) | (0.07) | (0.07) | (0.07) | (0.07) | (0.07) |
| (D) Ashless dispersing agent 10) | % by mass | 5 | 5 | 5 | 5 | 5 | 5 | 5 | 5 |
| (E) Antioxidant 11) | % by mass | 2 | 2 | 2 | 2 | 2 | 2 | 2 | 2 |
| Viscosity index improver 12) | % by mass | 4 | 4 | 4 | 4 | 4 | 4 | 4 | 4 |
| Anti-emulsifier 13) | % by mass | 0.01 | 0.01 | 0.01 | 0.01 | 0.01 | 0.01 | 0.01 | 0.01 |

TABLE 2-continued

| | | Comparative example 1 | Comparative example 2 | Comparative example 3 | Comparative example 4 | Comparative example 5 | Comparative example 6 | Comparative example 7 | Comparative example 8 |
|---|---|---|---|---|---|---|---|---|---|
| Storage stability test (vol %) | 1 WEEK | Generated (0.3) | Generated (0.3) | Not Generated | Not Generated | Generated (0.3) | Generated (0.3) | Not Generated | Not Generated |
| | 2 WEEK | Generated (0.3) | Generated (0.3) | Generated (0.02) | Generated (0.02) | Generated (0.3) | Generated (0.3) | Generated (0.02) | Generated (0.02) |
| | 3 WEEK | Generated (0.3) | Generated (0.3) | Generated (0.02) | Generated (0.02) | Generated (0.3) | Generated (0.3) | Generated (0.02) | Generated (0.02) |
| | 4 WEEK | Generated (0.3) | Generated (0.3) | Generated (0.02) | Generated (0.02) | Generated (0.3) | Generated (0.3) | Generated (0.02) | Generated (0.02) |

1) % $C_A$: 0, Sulfur content: 0 ppm by mass, 100° C. kinematic viscosity: 6.5 $mm^2/s$, viscosity index: 125
2) % $C_A$: 6.5, Sulfur content: 1700 ppm by mass, 100° C. kinematic viscosity: 6.9 $mm^2/s$, viscosity index: 100
3) Infineum C9371(SAP001) Total base value: 170 mgKOH/g, Ca content: 6.1% by mass, Metal ratio: 2.7, Alkyl groups: C14, C16, C18, Constituent ratio of monoalkyl compounds: 96 mol %
4) OSCA463 Total base value: 170 mgKOH/g, Ca content: 6.1% by mass, Metal ratio: 2.7, Alkyl groups: C14, C16, C18, Constituent ratio of monoalkyl compounds: 95 mol %
5) Total base value: 170 mgKOH/g, Ca content: 6.1% by mass, Metal ratio: 2.7, Alkyl groups: C14, C16, C18
6) Total base value: 170 mgKOH/g, Ca content: 6.1% by mass, Metal ratio: 2.7, Alkyl groups: C14, C16, C18
7) Total base value: 20 mgKOH/g, Ca content: 2.35% by mass, Metal ratio: 1.0
8) Total base value: 300 mgKOH/g, Ca content: 10.4% by mass, Metal ratio: 10.0
9) Alkyl group: 1,3-dimethylbutyl group, Phosphorus content: 7.2% by mass, Sulfur content: 14.4% by mass
10) Polybutenylsuccnimide, Number-average molecular weight of the polybutenyl groups: 1300
11) Phenol type and amine type antioxidants (1:1)
12) OCP Average molecular weight: 150000
13) Anti-emulsifier: polyoxyethylene alkyl ether About the resultants compositions, the following storage stability test was made.

(1) Storage Stability Test

A volume of 100 mL of each of the resultants lubricating oil compositions was put into a graduated test tube for centrifugation (see, for example, JIS K 2601), and the following cycle test was made: 0° C. for one week→60° C. for 1 week→0° C. for 1 week→60° C. for 1 week. It was checked with the naked eye whether or not a precipitation was generated.

Examples 1 to 8

Lubricating oil compositions of Examples 1 to 8 according to the invention were each a composition obtained by incorporating, into a lubricant base oil, calcium-carbonate-perbasic calcium (3-alkyl-5-methyl)salicylate or calcium (3,5-dialkyl)salicylate having a metal ratio of 2.7 as a component (A), calcium-carbonate-perbasic calcium sulfonate having a metal ratio of 1 or 10 as a component (B), (C) zinc dithiophosphate, (D) succinimide, (E) phenol type and amine type antioxidants, a viscosity index improver, and an anti-emulsifier. No precipitation was generated even after 4 weeks passed in the above-mentioned cycle test, so as to exhibit good storage stability. Calcium phenate having a metal ratio of 1 was used as the component (B). As a result, no precipitation was generated in the same manner, so as to exhibit good storage stability.

Comparative Examples 1 to 8

In the case of using, as the component (A) in Examples 1 to 8, calcium-carbonate-perbasic calcium (monoalkyl)salicylates having a metal ratio of 2.7 (about the constituent ratios of monoalkylsalicylates in the salicylate structure thereof, the ratio of C9371 manufactured by Infineum Co. (corresponding to SAP 001 manufactured by previous Shell Chemicals Japan) was 96% by mole and that of OSCA 463 manufactured by Osca Chemical Co. was 95% by mole) and calcium sulfonate having a metal ratio of 1 (Comparative Examples 1, 2, 5 and 6), a white precipitation which appeared to be calcium carbonate was evidently generated within one week. In the case of using calcium (monoalkyl) salicylate having a metal ratio of 2.7 together with perbasic calcium sulfonate having a metal ratio of 10 (Comparative Examples 3, 4, 7 and 8), the same precipitation was evidently generated within 2 weeks. Thus, it is understood that they were poor in storage stability.

INDUSTRIAL APPLICABILITY

The lubricating oil additive and the lubricating oil composition of the present invention generate no precipitation and have good storage stability. It has been become possible to supply a lubricating oil additive product or a lubricating oil composition product made of a combination of a (per)basic salicylate and a metal detergent such as (neutral) sulfonate, which has generated a precipitation so as not to be circulated as a product so far or so as to cause a trouble even if it has been circulated. It has been become possible to prevent the generation of troubles even under a situation that a salicylate-containing lubricating oil is mixed with another metal-detergent-containing lubricating oil or a situation that these are mixed with each other when the kind of oil is exchanged in a storage tank. It has been verified that the lubricating oil additive and the lubricating oil composition of the invention are good in high-temperature detergency and oxidation stability and can be made high in long drain property. It is also possible to give a desired performance to the additive or composition by incorporating various additives thereinto. Accordingly, the lubricating oil additive and the lubricating oil composition of the invention are useful as a lubricating oil additive or a lubricating oil composition, and can be preferably used as a lubricating oil additive and a lubricating oil composition for internal combustion engines such as gasoline engines, diesel engines and gas engines for two-wheeled vehicles, four-wheeled vehicles, power generation, ships or the like, in particular, a lubricating oil additive and a lubricating oil composition for internal combustion engines using low-sulfur fuels (for example, gasoline, light oil, natural gas and LPG which have a sulfur content of 50 ppm or less by mass, preferably 10 ppm or less by mass, or hydrogen, dimethyl ether (DME), gas-to-liquid (GTL) fuels (light oil fractions and gasoline fractions) and alcohol fuel which do not substantially contain sulfur) since long-drain performance can be made higher.

Moreover, the lubricating oil additive and the lubricating oil composition of the invention can be preferably used as a lubricating oil about which storage stability, high-temperature detergency and oxidation stability as described above are required, for example, a lubricating oil for a driving system such as an automatic or manual transmission, or a lubricating oil such as grease, wet brake oil, hydraulic oil, turbine oil, compressor oil, shaft bearing oil or refrigerator oil, and as an additive used therein.

The invention claimed is:

1. A lubricating oil additive consisting of: a lubricant base oil, (A) a salicylate detergent and (B) a metal detergent other than any salicylate detergent, wherein the salicylate detergent (A) is a (per) basic salt of an alkali metal or alkaline earth metal salicylate represented by the general formula (1):

(1)

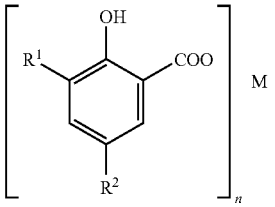

wherein one of $R^1$ and $R^2$ in the general formula (1) is a hydrocarbon which has 10 to 40 carbon atoms, and the other is a hydrocarbon which has less than 10 carbon atoms, M represents an alkali metal or alkaline earth metal, and n is 1 or 2 in accordance with the valence of the metal, the component (A) has a metal ratio of 2.3 or more and 6 or less, and component (B) is at least one selected from alkali metal or alkaline earth metal sulfonates and (per) basic salts thereof which has a metal ratio of 1 or more and 20 or less.

2. A lubricating oil additive consisting of: a lubricant base oil, (A) a salicylate detergent and (B) a metal detergent other than any salicylate detergent, wherein the salicylate detergent (A) is a (per) basic salt of an alkali metal or alkaline earth metal salicylate represented by the general formula (1):

(1)

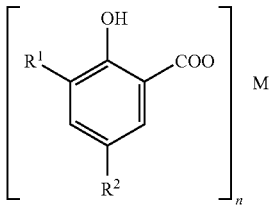

wherein $R^1$ and $R^2$ in the general formula (1) are each a hydrocarbon group having 10 to 40 carbon carbon atoms, M represents an alkali metal or alkaline earth metal, and n is 1 or 2 in accordance with the valence of the metal, the component (A) has a metal ratio of 2.3 or more and 6 or less, and component (B) is at least one selected from alkali metal or alkaline earth metal sulfonates and (per) basic salts thereof which has a metal ratio of 1 or more and 20 or less.

3. The lubricating oil additive according to claim 1, wherein one of $R^1$ and $R^2$ in the general formula (1) is a hydrocarbon which has 14 to 18 carbon atoms, and the other is a methyl group.

4. The lubricating oil additive according to claim 2, wherein $R^1$ and $R^2$ in the general formula (1) are each a hydrocarbon which has 14 to 18 carbon atoms.

* * * * *